United States Patent [19]

Sonner, Jr.

[11] Patent Number: 4,730,394

[45] Date of Patent: Mar. 15, 1988

[54] FOLDING CAMP KNIFE

[75] Inventor: Edwin W. Sonner, Jr., Tasley, Va.

[73] Assignees: Richard G. Sonner; Betty S. Hallbert, both of Duck Key, Fla.

[21] Appl. No.: 941,466

[22] Filed: Dec. 15, 1986

[51] Int. Cl.[4] ..... B26B 3/06

[52] U.S. Cl. ..... 30/161; 30/160; 30/155

[58] Field of Search ..... 30/160, 161, 155, 158

[56] References Cited

U.S. PATENT DOCUMENTS

| | | | |
|---|---|---|---|
| 401,549 | 4/1889 | Gemrig | 30/160 X |
| 512,965 | 1/1894 | Hoyer | 30/161 |
| 576,862 | 2/1897 | Lebold . | |
| 1,252,486 | 1/1918 | Paulson | 30/161 |
| 1,667,462 | 4/1928 | Logan . | |
| 1,782,901 | 11/1930 | Kassel . | |
| 4,541,175 | 9/1985 | Boyd | 30/161 |

FOREIGN PATENT DOCUMENTS

| | | | |
|---|---|---|---|
| 366170 | 9/1906 | France | 30/161 |

*Primary Examiner*—E. R. Kazenske
*Assistant Examiner*—Willmon Fridie, Jr.
*Attorney, Agent, or Firm*—Griffin, Branigan & Butler

[57] ABSTRACT

A folding camp knife (10) comprises an elongated handle case (12) having sideplates (24*a* and *b*) separated by a blade gap (26) in which a blade (14) is mounted for rotation by means of an axle pin (16) passing through holes (30 and 54) in the sideplates and the blade. A locking piece (18) engages the axle pin on the outside of the handle case and can both rotate about and slide longitudinally along the axle pin. The locking piece includes a locking flag (68) which can be moved into handle and blade peripheral locking slots (38*a* and *b* and 52) when they are in registration. Once the locking flag is slid into these peripheral locking slots the axle pin can be tightened against the locking piece to prevent further movement of the locking piece, thereby preventing rotational movement between the blade and the handle case. The axle end of the blade has a plurality of locking slots (52*a–e*) extending thereabout which allow the blade to be placed at various angles.

13 Claims, 6 Drawing Figures

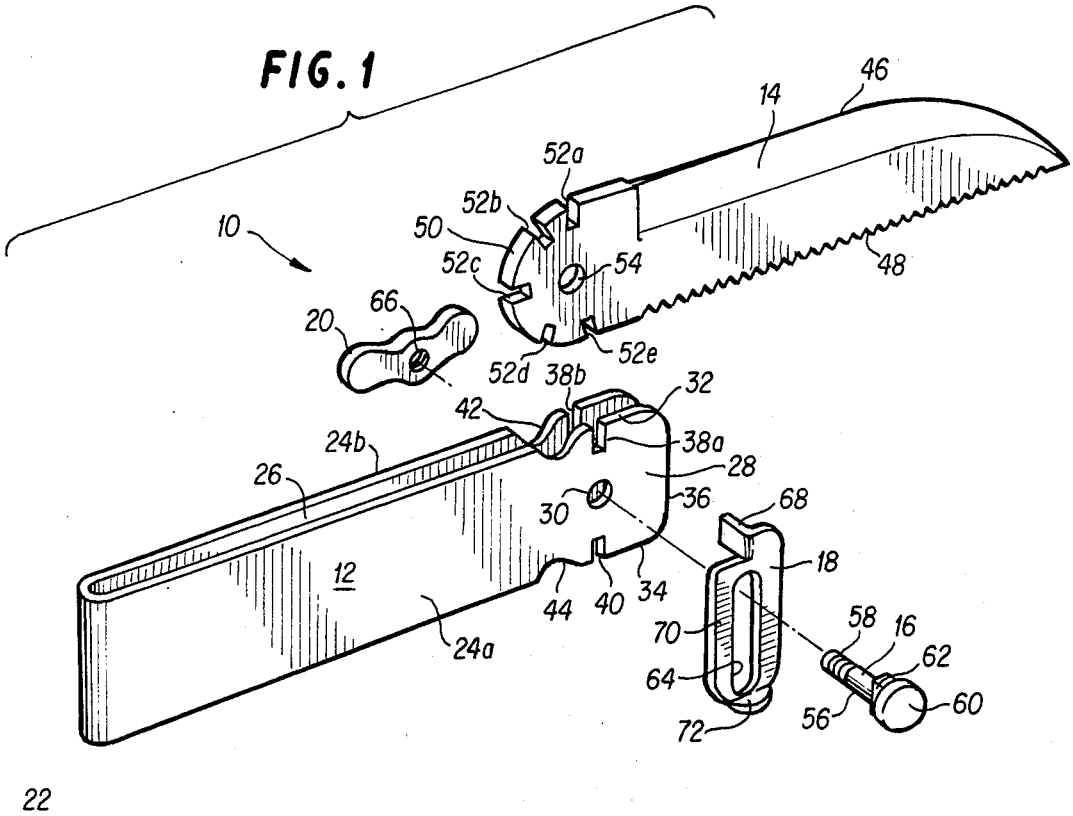
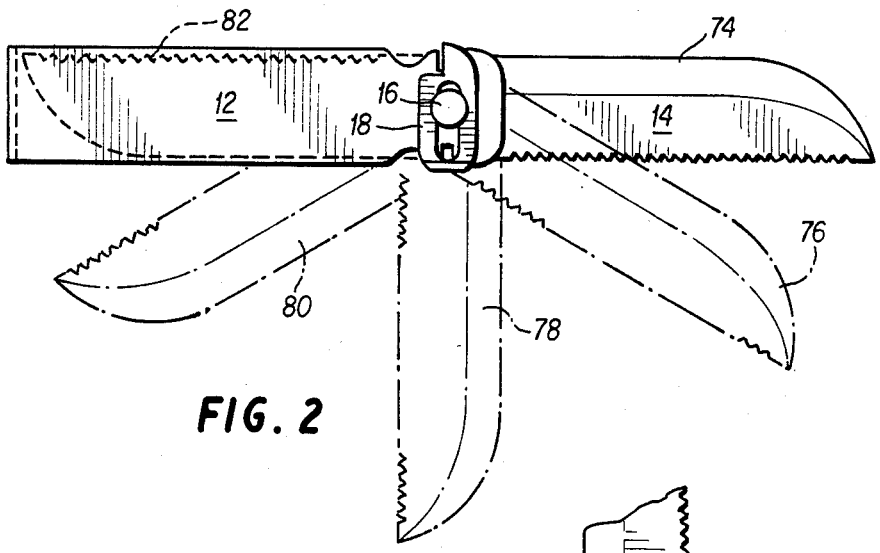
FIG. 2
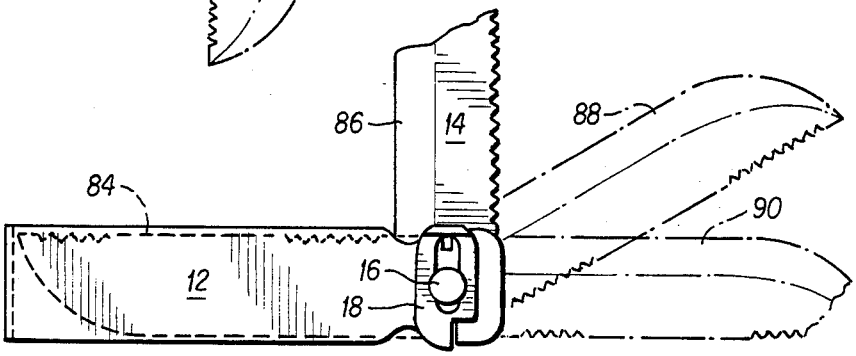
FIG. 3

FOLDING CAMP KNIFE

BACKGROUND OF THE INVENTION

Most folding knives, such as pocket knives and other utility knives which allow a blade to fold into a handle, have several major drawbacks. One such drawback is that most prior-art folding knives utilize rather powerful springs to hold blades either in fully open (180°) positions or in closed (0°) positions. This often makes such knives difficult to open with one's fingers because one can only grip edges of the blades thereof. On the opposite side of this problem, however, is the problem one encounters with a folding knife that does not use a very strong spring. When the blade of such a knife is fully open, it can easly by inadvertently closed, thereby endangering fingers gripping a handle thereof. It is therefore an object of this invention to provide a folding camp knife in which a blade is not held in the closed position by means of a spring at all, so that the blade can be easily moved out of its handle, but yet which when the blade is in a desired position, either in the handle, or out of the handle, it is positively fixed in that position and cannot be inadvertently moved therefrom to endanger a user's fingers or to cause other problems.

Yet another problem with most prior art folding knives is that they are difficult to clean when they have been used in a dirty environments. That is, filth gets into blade slots of handles thereof and it is difficult to clean the slots out. Thus, it is an object of this invention to provide a folding camp knife which not only can be quickly and easily cleaned when it is assembled, but which can be easily disassembled when necessary so that all parts thereof can be cleaned individually and then reassembled.

Yet another difficulty with most prior art folding knives is that the blades thereof can only be placed in two stable positions, either folded into their handles or fully extended at 180° to their handles. However, there are many applications for knives whose blades can be placed in various fixed positions relative to handles thereof. These prior art folding knives do not take advantage of the fact that their blades pass through various angles relative to their handles when being opened and closed. It is an object of this invention to provide a folding camp knife whose blade can be fixed at various angles relative to its handle case so that the knife can be utilized by pulling the blade fixed at 90° relative to the handle, or for many other applications, some of which are described herein, which are allowed by fixing the blade at various angles to its handle case.

It is a further object of this invention to provide a folding camp knife having the qualities mentioned above which is uncomplicated in structure, relatively inexpensive to manufacture, but yet is highly durable and effective in use.

SUMMARY

According the principles of this invention, a folding camp knife comprises an elongated handle having sideplates with a blade gap therebetween. The blade is mounted at an axle end of the handle by passing an axle pin through holes in the sideplates and an axle end of the blade. A locking piece is slidably and rotatably mounted on the axle pin and there are peripheral locking slots in the sideplates and the blade. The axle pin can be selectively tightened or loosened to fix the position of the locking piece relative to the handle sideplates, or allow angular adjustment of the blade. In operation the axle pin is loosened, the axial piece is moved so that a locking flag thereof is not in any of the peripheral locking slots, the blade is moved to a position in which one of its blade locking slots registers with a set of handle locking slots in the handle sideplates, the locking piece is slid on the axle pin to insert the locking flag in these coincidence locking slots, and the axle pin is then tightened, thereby fixing the locking piece's position as well as the angular position of the blade relative to the handle case.

In one embodiment, the handle case is constructed of a single piece of metal which is folded on itself to form the two sideplates.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is an exploded perspective view of a folding camp knife employing principles of this invention;

FIG. 2 is a side view of the folding camp knife of FIG. 1 with the blade thereof being locked in the 180° position by a locking piece in a first position, but with other possible blade positions being shown in phantom;

FIG. 3 is a side view of the folding camp knife of FIG. 1 with its blade being locked in the 90° position by a locking piece in a second position, and other blade positions being shown in phantom;

DESCRIPTION OF THE PREFERRED EMBODIMENT

Figure 4:
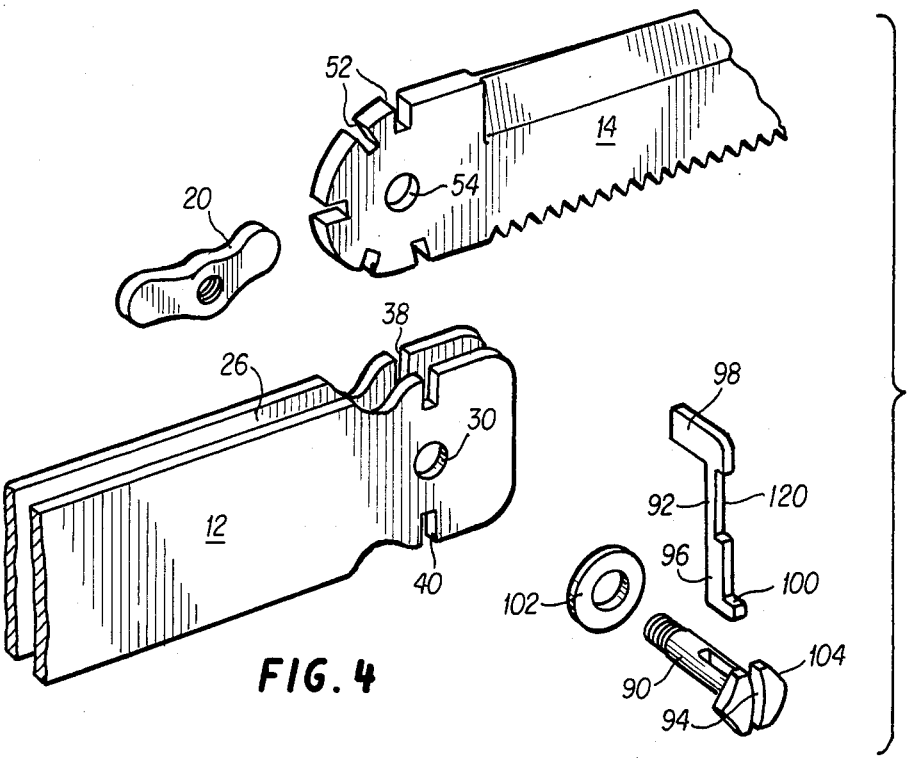
FIG. 4 is an exploded perspective view of another embodiment locking mechanism of this invention for use with a folding camp knife of the type shown in FIG. 1.

Turning first to FIG. 1, a folding camp knife 10 comprises generally a handle case 12, a blade 14, an axle pin 16, a locking piece 18, and an axle pin nut 20.

The handle case 12 is formed of a single piece of 1/16 inch steel, which has been bent at its bottom end 22. Sideplates **24*a* and 24*b* of the handle case 12 are mirror images of each other and the bend at the bottom end 22 is such that these sideplates 24*a* and 24*b* are separated by a blade gap 26 which is sufficiently wide to allow the blade 14 to easily move therethrough. Edges of the sideplates 24*a* and *b* are smooth so that the handle case 12 feels comfortable to a hand gripping it. An axle end 28 of the handle case 12 defines concentric, centrally-located handle axle holes 30, which pass through both sideplates 24*a* and 24*b* (although a hole can only be seen passing through sideplate 24*a* in FIG. 1). With regard to their location, the handle axle holes are positioned approximately equal distances from side edges 32 and 34** and axle end edge 36 of the handle case 12. Aligned peripheral, first handle locking slots 38*a* and 38*b* extend from the handle side edge 32 into each of the sideplates 24*a* and 24*b*, approximately radially directed toward the handle axle holes 30. Similarly, aligned peripheral, second handle locking slots 40 extend from the handle side edge 34 toward the axle hole 30, although only one of these handle locking slots 40 can be seen in FIG. 1. Thumb notch pairs 42 and 44 also extend from opposite handle edges 32 and 34 into the sideplates 24*a* and 24*b*.

The blade 14 has a cutting edge 46 on one longitudinal edge, and a fish scaler 48 on the opposite edge. An axle end of the blade has a semicircular shape 50 with a plurality of radially directed blade locking slots 52*a–e* therein directed toward a centrally located blade axle hole 54.

The axle pin 16 comprises a shaft 56 having threads 58 at an outer end and a head 60 at the other end thereof. The head 60 is round on its top, however, that portion which is attached to the shaft 56 is narrowed to form a ridge having parallel walls 62 (only one shown in FIG. 1) so that it will fit into a track groove 64 of the locking piece 18. The pin shaft 56 will pass through the track groove 64 of the locking piece 18 with the ridge parallel walls 62 having sliding contact with the edge of the track groove 64 so as to allow both rotative and sliding movement of the locking piece 18 relative to the axle pin 16. The ridge of the pin head 60 is not as high as the 1/16 inch width of the locking piece 18. A major function of the ridge walls 62 is to contact sides of the track groove 64 and thereby prevent rotation of the axle pin 16 when the axle pin wing nut 20 is turned to tighten or loosen the axle pin 16. The pin shaft 56 also passes snugly through the handle axle hole 30 of the handle sideplate 24*a* then through the blade hole 54 and then through the other handle axle hole (not shown) in the sideplate 24*b*. Finally, the shaft 56 is screwed into a threaded hole 66 of the axle-pin wing nut 20.

The locking piece 18 is of steel and includes a locking flag 68 which is bent on a 90° angle to the main body 70 of the locking piece. The opposite end of the locking piece 18 has an upward bend 72 thereon which allows one to grip the locking piece for sliding it longitudinally relative to the axle pin 16.

In operation, the blade 14 is placed in the blade gap 26 of the handle case 12 with its axle hole 54 aligned with the handle axle holes 30 of the handle case. The locking piece 18 is placed on the side of the handle case as is depicted in FIGS. 2 and 3 with the track groove 64 thereof being coincident with the handle axle holes 30. The axle pin 16 is then inserted through the track groove 64, the handle axle holes 30, and the blade axle hole 54. Threads 58 of the axle pin 16 are then engaged with female threads 66 of the axle-pin wing nut 20.

To move the blade to a desired angle, the axle-pin wing nut 20 is loosened, the blade 14 is rotated on the axle pin 16 until one of the blade locking slots 52*a–e* is aligned with the handle locking slots 38*a* and 38*b*. The locking piece 18 is then slid along the axle pin 16 until its locking flag 68 enters the chosen blade locking slot 52 and handle locking slots 38*a* and *b*. The axle pin wing nut 20 is then tightened on the threads 58 of the axle pin 16 to pull the axle pin head 60 tightly against the locking piece 18 and the locking piece 18 tightly against the outside side surface of the handle sideplate 24*a*, thereby clamping the locking piece 18 in this position with its locking flag 68 in the aligned blade and handle locking slots. In this mode, the blade and handle are fixed relative to one another and the folding steel knife of this invention can be used without fear of the blade suddenly folding. It will be readily appreciated that by choosing the appropriate blade locking slot 52*a–e* one can place the blade in various angles relative to the handle case 12. In this respect, with reference to FIG. 2, when the locking flag 68 is used with the handle locking slots 38*a* and 38*b*, the locking flag 68 can be inserted in blade locking slot 52*a* to place the blade at a 180° angle relative to the handle, thus forming a normal knife. If the locking flag 68 is placed in the handle locking slot 38*a* and *b* and the blade locking slot 52*b*, the blade achieves approximately a 135° position 76. Such a position is quite helpful for general use, especially for skinning game, depending on the manner in which the folding camp knife is to be used. If handle locking slots 38*a* and 38*b* and blade locking slots 52*c* are held in coindence by the locking flag 68, the blade achieves a 90° position 78. In this position, the blade can be most effectively used by pushing it with the handle with the little finger nearest the blade The blade can also be fixed in the position shown at 80, using the blade locking slot 52*d*, although no conventional uses for this position are presently known. Finally, the blade can be stored in a 0° position 82 by inserting the locking flag 68 in handle locking slots 38*a* and 38*b* and in the blade locking slot 52*e*.

To achieve the blade positions of FIG. 3, the blade 14 is rotated through the handle blade gap 26 and the locking piece 18 is rotated 180° to its second position so that the locking flag 68 now inserts into the handle locking slots 40 rather than into the handle locking slots 38. Thus, in the 0° position 84 depicted in FIG. 3 the locking flag 68 is in the blade slot 52*a*. In the 90° position 86 the locking flag 68 is in the blade locking slot 62*c*. In this position the cutting edge 46 of the blade 14 can be pulled like a draw knife with the handle case 12 being held with the index finger nearest to the blade. Also in this position, the handle case 12 can be held with the little finger close to the blade while the fish scaler 48 is pushed. By pushing the fish scaler, fish scales are thrown away from a user. In the 135° position 88 the locking flag 68 is in the blade locking slot 52*d* and in the 180° position 90 the locking flag 68 is in the blade locking slot 52*e*. Each of these blade positions has distinct advantages under certain circumstances. In particular, the 90° position 86 allows one to pull the blade using the handle 12 which sometimes provides more blade control.

All parts of the folding camp knife described above are easily accessible and therefore can be easily washed. In this respect, these members can be easily taken apart by simply removing the wing nut 20 from the axle pin 16.

Figure 5:
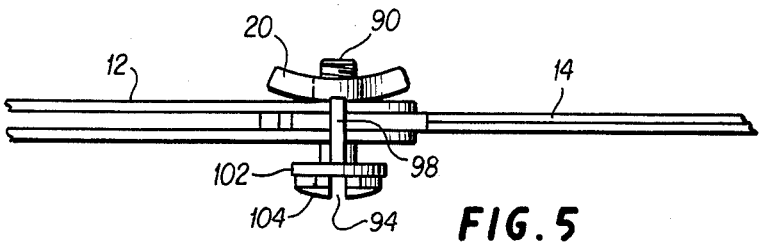
FIG. 5 is a top view of the axle/locking mechanism shown in FIG. 4 when it is fully assembled with the blade thereof being in the 180° position; and, FIG. 6 is an exploded perspective view of a third embodiment locking mechanism of this invention for use in a folding camp knife of the type shown in FIG. 1, however, a blade and handle-case sideplates not being shown.

An alternate embodiment blade-locking mechanism shown in FIGS. 4 and 5 invovles the blade 14, identical to the blade of FIG. 1, and a handle case 12, identical to the handle case of FIG. 1. However, an axle pin 90, and locking piece 92 are quite different frOm their counterparts of FIG. 1 in that the axle pin 90 has a longitudinal groove 94 in his head end and the locking piece 92 is formed of non-bent steel cut-out. With regard to the locking piece 92, it can be formed simply by blanking it from sheat steel to have a main body 96, a locking flag 98 and a stop 100. To assemble the locking mechanism of FIG. 1, a washer 102 is first placed on the axle pin 90 which is shoved up to an axle pin head 104. The stop end 100 of the locking piece 92 is then inserted through the longitudinal groove 94 below the washer 102 with the locking flag 98 being parallel with the axle pin 90 and facing the axle pin's threads. The axle pin 90 is then inserted through the handle axle holes 30 and blade axle hole 54 and finally screwed into the axle-pin nut 20.

To adjust the angle of blade 14 relative to the handle case 12 for the FIG. 4 embodiment, the axle-pin nut 20 is loosened so that the locking piece 92 can be slid in the longitudinal groove 94 to be moved in and out of handle locking slots 38 and blade locking slots 52. The locking piece 92 and the axle pin 90 can be rotated so that the locking flag 98 can also be moved in and out of handle locking slots 40. The stop 100 contacts the washer 102 to prevent the locking piece 92 from being completely removed from the longitudinal groove 94 unless the axle-pin nut 20 is loosened to a large exent.

The locking mechanism of the FIG. 4 embodiment has the advantage that the locking piece 92 can be blanked in a single manufacturing step and need not be bent, as must the locking flag 68 of locking piece 18 of FIG. 1. However, it has the disadvantage that the head end of the locking pin 90 protrudes relatively far away from the handle case 12, as is depicted in FIG. 5. It will be appreciated that the locking device of FIGS. 4 and 5 allows the full range of blade position adjustments described for the locking device of FIGS. 1–3.

Figure 6:
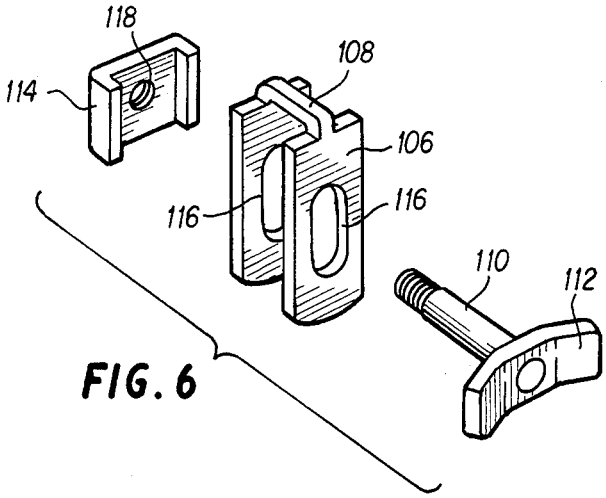

FIG. 6 depicts yet another locking mechanism embodiment in which a locking piece 106 extends on both sides of the handle case 12 with a locking flag 108 extending therebetween. An axle pin 110 has a butterfly-like head 112 thereon for use in tightening and loosing the pin in a channel-shaped nut 114. A channel of the channel nut 114 fits on a side of the locking piece 106 in order to prevent it from turning when the axle pin 110 is turned, while still allowing longitudinal movement of the locking piece 106. To utilize the locking mechanism of FIG. 6, the axle pin 110 is extended through a track groove 116 in the locking piece 106, and then through the first handle axle hole, the blade axle hole 54, the other handle axle hole 30, the other track groove 116, and finally is engaged with a threaded hole 118 of the channel-shaped nut 114.

The elongated shape of the track grooves 116 allows the locking piece 106 to be both slid and rotated on the axle pin 110 when the axle pin is loosened from the nut 114 for engaging and disengaging the locking flag 108 from handle locking slots 38 and 40 and blade locking slots 52. Again, this mechanism allows the full range of blade positions as are described for the embodiment of FIGS. 1–3.

It can be appreciated by those of ordinary skill in the art that the folding camp knife described herein not only allows its blade to be solidly affixed at various selected angles, but it is easy to clean because its open construction allows a rag or brush to be thrust through its handle case when the blade is open and/or, when necessary, it can be easily disassembled for even more efficient cleaning. Such a feature is very important when one uses this knife for fish cleaning for example. Further, the folding camp knife of this invention is easy to open and close because it has no spring resistance. In this respect, the blade 14 can be pushed down or up using one thumb at the opposite notch pairs 42 and 44. In some embodiments it is also possible to utilize the locking flag 68 for pushing on the blade 14 at the notch pairs 42 and 44 to shove the blade out of the handle case 12.

Not only can various blade positions be selected, the selection is easy to make. This adjustment can be made in the dark since one can apply radial pressure on the locking flag 68 into the handle locking slots as one rotates the blade until the locking flag falls into the blade locking slot. Thus, slots do not have to be visually aligned. To make this procedure easy, the width of the axle end of the blade 14 is slightly less than the width of the handle case 12 so that the periphery of the axle end of the blade allows the locking flag 68 to enter mouths of the handle locking slots 38*a* and *b* even when the handle locking slots 38*a* and *b* are not aligned with a blade locking slot 52. Also, the axle end of the blade 14 is well rounded.

The locking mechanism is extremely strong in that the steel locking flag 68 is held at both ends thereof by handle locking slot edges and is therefore not easily bent by force applied to the blade 14.

When tightened, the wing nut clamps the handle sideplates tightly against the blade which prevents side play, or wobble, as is found in many pocket knives, between the blade and the handle case.

Since the folding camp knife is so easy to disassemble, it is possible to have replacement parts and even replacement blades therefore. In this respect, in one embodiment, there are many different types of blades for performing different functions. For example, in addition to having a fish scaler blade, there can be a blade for sawing wood.

The folding camp knife of this invention is of strong, but yet inexpensive construction. It is very compact and extremely useful.

Although there could be more blade locking slots 52*a–e* than are depicted herein, the allowable distances between slots would depend on dimensions of the blade and the blade slots and also on the type and temper of blade metal. In any event, blade slots should be separated enough to leave a substantial amount of metal between adjacent slots. Otherwise, the areas between the slots could chip out if someone uses the blade for chopping or the like.

While the invention has been particularly shown and described with reference to a preferred embodiment, it will be understood by those skilled in the art that various changes in form and detail may be made therein without departing from the spirit and scope of the invention. For example, it would be possible to modify the locking piece 18 to include thereon a counter sunk depresson on the pin-head side thereof to mate with the axle pin head 60 when the locking pices 18 is in the blade locking position. When the axle pin head 60 is drawn into this counter-bored depression by tightening the wing nut 20, the locking piece 18 is more securely held in the blade-locking position. In this manner, the axle pin 16 could be loosened from the axle-pin nut 20 so that its head 60 can be lifted out of the depression and the locking piece 18 can then be slid to an unlocking position. Such an arrangement provides more positive locking of the locking piece 18 than the friction lock depicted on the drawings herewith. However, it has the disadvantage that in order to loosen the locking piece 18 the axle-pin nut 20 must be rotated to a greater degree than is necessary for the embodiment of FIG. 1. Also. the depth of the ridge forming walls 62 would have to be reduced by an amount equal to the depth of the counter-bored depression. A similar embodiment could be produced with the locking piece 92 of FIG. 4 by putting a depression 120 (FIG. 4) on the pin-head edge thereof which mates with the washer 102. With the arrangement described for FIG. 1, the axle pin 16 must only be slightly loosened and the locking piece can be easily slid thereafter. Further, in the arrangement of FIG. 1 the friction lock appears to be sufficient.

In yet another embodiment, the handle case 12 is made of a soft material, such as a bent piece of aluminum or a molded piece of plastic. In this case, it is necessary to utilize steel lining plates at least at the axle end 28 fastened to the side plates 24*a* and 24*b* of the handle case 12. These lining plates have the same shape as the axle end 28, having axle holes 30 and locking slots 38 and 40 therein. These lining plates provide strength for locking the blade 14 to the handle case 12.

The embodiments of the invention in which an exclusive property or privilege are claimed are defined as follows:

1. A folding camp knife comprising:

an elongated handle case having aligned opposite side plates with a blade gap therebetween, at an axle end of said handle case said opposite side plates having coaxial, centrally-located handle axle holes therethrough and at least one set of parallel handle locking slots extending from side-edge peripheries of the sideplates, said locking slots being directed approximately toward the centrally-located axle holes of the sideplates;

an elongated blade having an axle end for engaging the axle end of said handle, said blade axle end also having a centrally-located blade axle hole therein, said elongated blade being positioned in said blade gap of said handle case with said blade axle hole being aligned with said handle axle holes, said blade axle end further including a plurality of blade locking slots therein, each extending from the edge periphery of said blade inwardly, approximately directed toward said centrally-located blade axle hole, said blade locking slots registering with said handle locking slots when said blade is rotated to particular angular positions relative to said handle at said handle and blade axle holes;

an axle pin means having an axle pin extending through said handle and blade axle holes for mounting said blade on said handle case to allow selective angular rotation therebetween;

a locking piece engaging said axle pin and being slidable thereon, said locking piece extending radially from said axle pin to the periphery of the handle case and the blade and including a locking flag for extending in a direction approximately parallel with the axle pin across the edge peripheries of said handle sideplates and said blade, said locking flag having a shape and size for fitting into said handle and blade locking slots;

whereby said blade can be rotated relative to said handle case on said axle pin to bring said handle and blade locking slots into registration and said locking piece can be slid on said axle pin to insert said locking flag into said blade and handle locking slots to prevent relative rotation between said handle and blade during use of said camp knife.

2. A folding camp knife as in claim 1 wherein said axle pin includes a fastening means for allowing its loosening and tightening for selectively further engaging said locking piece and thereby preventing longitudinal movement of the locking piece.

3. A folding camp knife as in claim 2 wherein said fastening means includes a threaded nut for engaging threads at one end of said axle pin.

4. A folding camp knife as in claim 2 wherein said axle pin, when tightened, makes frictional engagement with said locking piece for preventing said locking piece from moving longitudinally.

5. A folding camp knife as in claim 2 wherein said handle case is constructed of one piece folded on itself to form said side-plates.

6. A folding camp knife as in claim 1 wherein said handle case is constructed of one piece folded on itself to form said side-plates.

7. A folding camp knife as in claim 1 wherein said blade has at least three blade locking slots therein.

8. A folding camp knife as in claim 7 wherein said blade has at least five blade locking slots therein.

9. A folding camp knife as in claim 1 wherein said locking piece is constructed of a flat member having an elongated track groove therein with said locking flag being bent at a 90° angle to a main body thereof.

10. A folding camp knife as in claim 1 wherein said locking piece is a single flat, cut-out member and said axle pin is slotted at a head end thereof to allow insertion of said locking piece therethrough.

11. A folding camp knife as in claim 1 wherein said locking piece is U-shaped, extending on both sides of the handle case and the axle pin passes through track grooves of said locking piece positioned on opposite sides of the handle case.

12. A folding camp knife as in claim 1 wherein said blade gap of said handle case is open at opposite edges of said handle case so that said blade can be rotated on said axle pin through said handle case.

13. A folding camp knife as in claim 12 wherein said opposite sideplates including two sets of handle locking slots located at opposite edges of said handle axis holes and wherein said locking piece can be rotated 180° about said axle pin so that said locking flag can be inserted into either of said sets of said handle locking slots.

* * * * *